US011963629B2

(12) United States Patent
Norstrem

(10) Patent No.: US 11,963,629 B2
(45) Date of Patent: Apr. 23, 2024

(54) THERAPEUTIC PILLOW

(71) Applicant: Core Products International, Inc., Osceola, WI (US)

(72) Inventor: Paul R. Norstrem, Dresser, WI (US)

(73) Assignee: Core Products International, Inc., Osceola, WI (US)

( * ) Notice: Subject to any disclaimer, the term of this patent is extended or adjusted under 35 U.S.C. 154(b) by 223 days.

(21) Appl. No.: 17/453,771

(22) Filed: Nov. 5, 2021

(65) Prior Publication Data

US 2022/0142384 A1 May 12, 2022

Related U.S. Application Data

(60) Provisional application No. 63/110,556, filed on Nov. 6, 2020.

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC .. A47G 9/1045; A47G 9/1054; A47G 9/1072; A47G 9/1081; A47G 9/109; A47G 9/10; A47G 2009/1018
See application file for complete search history.

(56) References Cited

U.S. PATENT DOCUMENTS

| | | | | |
|---|---|---|---|---|
| 5,727,267 | A * | 3/1998 | Keilhauer | A47G 9/109 5/636 |
| 7,082,633 | B1 * | 8/2006 | Maarbjerg | A47G 9/10 5/636 |
| 8,161,588 | B1 * | 4/2012 | Anson | A47G 9/109 5/636 |
| 9,757,303 | B2 * | 9/2017 | Marinkovic | A61H 1/008 |
| 10,722,058 | B1 * | 7/2020 | Wagner | A47G 9/109 |
| 2012/0017374 | A1 * | 1/2012 | Hunter | A47G 9/109 5/638 |
| 2012/0255126 | A1 * | 10/2012 | Abdo | A47G 9/109 5/636 |
| 2013/0047339 | A1 * | 2/2013 | Kim | A47G 9/109 5/636 |
| 2013/0198961 | A1 * | 8/2013 | Davis | A47C 7/029 5/648 |
| 2019/0069698 | A1 * | 3/2019 | Lin | A47G 9/1009 |
| 2020/0268183 | A1 * | 8/2020 | Murphy | A47G 9/109 |
| 2021/0037996 | A1 * | 2/2021 | Liu | A47G 9/1054 |
| 2022/0248882 | A1 * | 8/2022 | Sramek | A47G 9/1072 |
| 2022/0265464 | A1 * | 8/2022 | Baek | A61F 5/56 |

* cited by examiner

*Primary Examiner* — Justin C Mikowski
*Assistant Examiner* — George Sun
(74) *Attorney, Agent, or Firm* — Schwegman Lundberg & Woessner, P.A.

(57) ABSTRACT

A cervical orthotic device is generally provided. In an example, the device can include a base, sidewalls extending upwardly from the base, and a cervical support surface opposite the base and configured to unite the sidewalls. In certain examples, the sidewalls can include opposingly paired lateral sidewalls and first and second longitudinal sidewalls. In some examples, the cervical support surface can include a first planar portion adjacent the first longitudinal sidewall, a second planar portion adjacent the second longitudinal sidewall, and an arcuate portion intermediate the planar portions.

19 Claims, 3 Drawing Sheets

THERAPEUTIC PILLOW

CLAIM OF PRIORITY

This application claims the benefit of priority under 35 U.S.C. § 119(e) of U.S. Provisional Patent Application Ser. No. 63/110,556, filed on Nov. 6, 2020, which is herein incorporated by reference in its entirety.

TECHNICAL FIELD

The disclosure herein relates generally to pillows and more particularly to a contoured pillow offering multiple head and neck support options.

BACKGROUND

The standard rectangular pillow has been in common use for many years. However, this type of pillow suffers from serious draw backs in that they provide relatively poor sleeping support to the user. The support that is provided is generally uneven and can result in serious discomfort and exacerbation of preexisting injuries. Poor support during sleep can cause headache, neck ache, back ache, and other muscular discomfort.

Recognizing these drawbacks has brought to market various types of contoured pillows that provide support structures for the head and neck. However, such designs present limited support options. As a user's needs can change over time or can be affected by weekly or daily activities, the support provided by the limited options of conventional contour pillows may not be effective to soothing or mitigating the aches and discomfort that may come along with the changes. Further, there are many variations in the physical structure of the human body. Overall size, neck length, head size, trunk size, etc. all cause variations in sleeping posture. It is difficult for an individual to identify one pillow that provides proper support.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not limitation, in the figures of the accompanying drawings in which.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments.

The present inventor has recognized a contoured pillow that provides multiple combinations of head, neck and shoulder support that can address changes in a user's support needs or a proper fit for a variety of physical body types. In addition, when covered with a pillowcase, the pillow can appear as a standard rectangular pillow which can be an important aesthetic attribute in some situations.

Figure 1A:
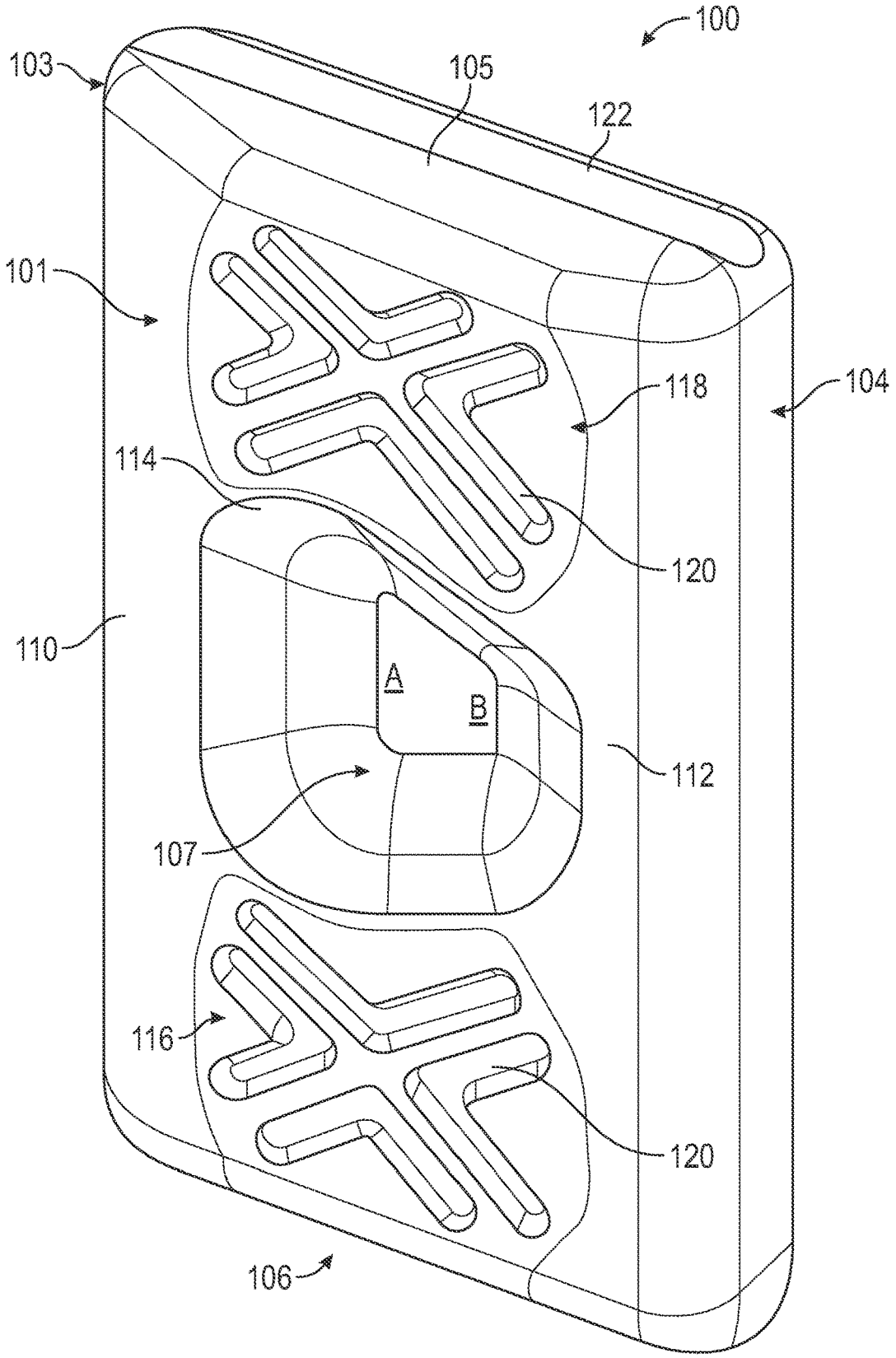
FIGS. 1A and 1B illustrate generally perspective views of an example pillow 100 according to the present subject matter.
Figure 1B:
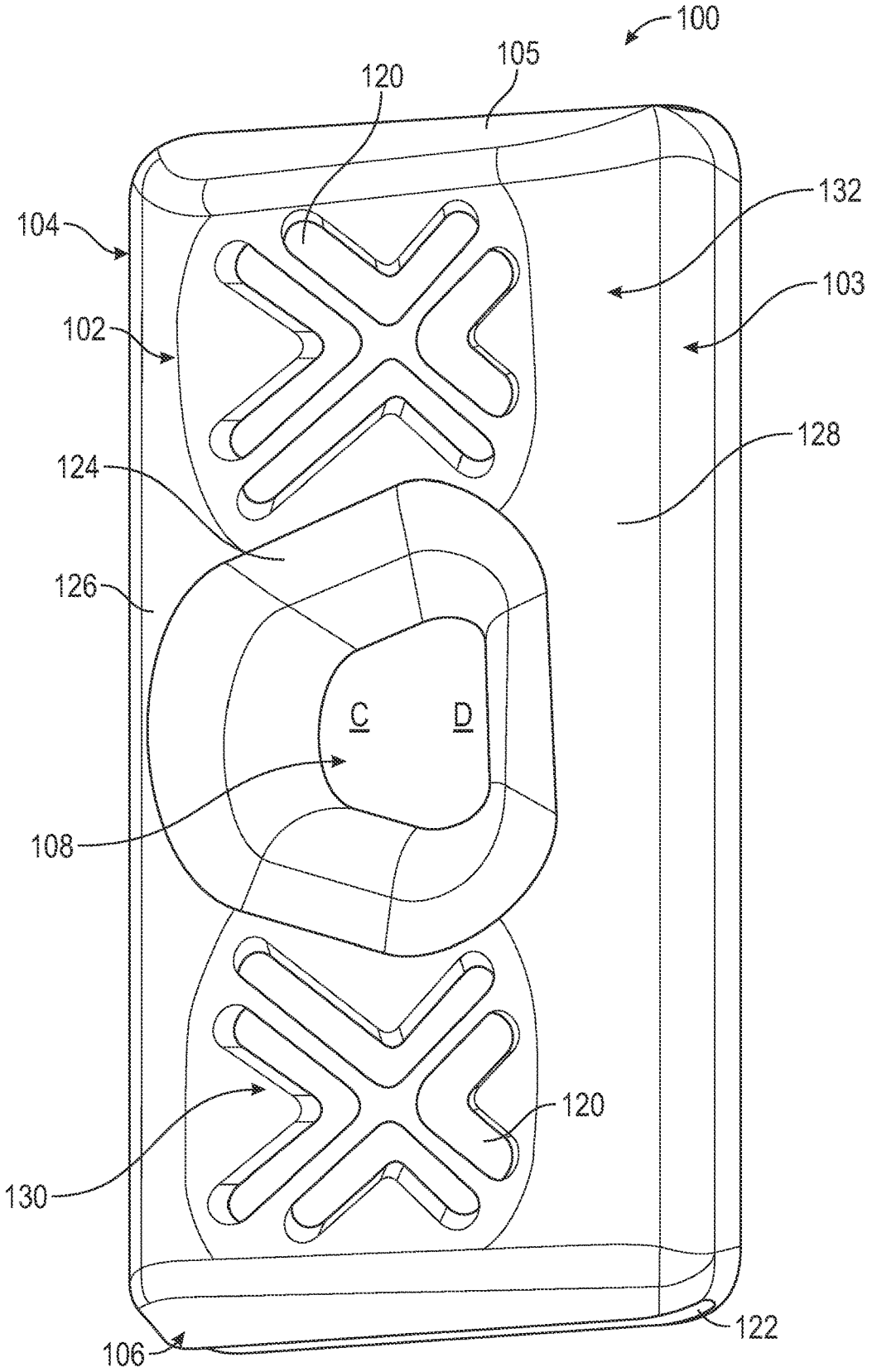

FIGS. 1A and 1B illustrate generally perspective views of an example pillow 100. The pillow 100 is generally rectangular in shape and includes a first major side 101, a second major side 102, first and second longitudinal sidewalls 103, 104, and first and second lateral sidewalls 105, 106. FIG. 1A generally highlights the first major side 101 of the pillow 100, and FIG. 1B generally highlights the second major side 102 of the pillow 100. Each major side of the pillow can include a single cavity 107, 108 for supporting the user's head and a plurality of channels 120. A first longitudinal sidewall 103 of the pillow 100 can be shaped differently than a second major side 104 of the pillow 100.

The cavities 107, 108 in each of the first and second major sides 101, 102 are configured to support the back of a head of user when the user lays atop the pillow 100 in a supine position. Referring to FIG. 1A, the single cavity 107 of the first major side 101 can be sized and shaped to envelop a portion of the back of the user's head when the shoulders of the user are aligned parallel with one of the first and second longitudinal sidewalls 103, 104 of the pillow 100. In certain examples, a rim 114 of the cavity 107 can form a closed shape. The edge areas 110, 112 of the cavity 107 adjacent the first and second longitudinal sidewalls 103, 104 can provide support for the neck or shoulders of the user. In certain examples, different shapes or thicknesses, of the first and second longitudinal sidewalls 103, 104 can provide different levels of neck or shoulder support.

Referring to FIG. 1B, the single cavity 108 of the second side 102 can be sized and shaped to envelop a portion of the back of the user's head when the shoulders of the user are aligned parallel with one of the first and second longitudinal sidewalls 103, 104 of the pillow 100. In certain examples, a rim 124 of the cavity 108 can form a closed shape. The edge areas 126, 128 of the cavity 108 adjacent the first and second longitudinal sidewalls 103, 104 can provide support for the neck or shoulders of the user. In certain examples, different shapes or thicknesses, of the first and second longitudinal sidewalls 103, 104 can provide different levels of neck or shoulder support. Therefore, each of the first and second major sides 101, 102 of the pillow 100 can provide a user a first orientation, relative to the user, with a first neck or shoulder support, and a second orientation with a second neck or shoulder support.

For example, in certain examples, the shape of the first longitudinal sidewall 103 of the pillow 100 can provide a thicker cross-section of the pillow compared to the shape of the second longitudinal sidewall 104 of the pillow 100. Therefore, when the user lays in a supine position with the user's head in the cavity 107 of the first major side 101 of the pillow 100, the shoulders of the user adjacent the first longitudinal sidewall 103, and the top of the head of the user adjacent the second longitudinal sidewall 104, a first edge area 110 of the first major side 101 between the cavity 107 and the first longitudinal sidewall 103 can provide a first level of neck or shoulder support in combination with the depth of the cavity 107. In certain examples, the first edge area 110 can include an edge or sidewall of the cavity 107. Likewise, when the user lays in a supine position with the user's head in the cavity 107 of the first major side 101 of the pillow 100, the shoulders of the user adjacent the second longitudinal sidewall 104, and the top of the head of the user adjacent the first longitudinal sidewall 103, a second edge area 112 of the first major side 101 between the cavity 107 and the second longitudinal sidewall 104 can provide a second level of neck or shoulder support in combination with the depth of the cavity 107 of the first major side 101 of the pillow 100. In certain examples, the second edge area 112 can include an edge or sidewall of the cavity 107. Flipping the pillow over offers an additional two orientations providing a third and fourth level of support based on the first or second edge area 126, 128 of the second side 102 supporting the neck of the user in combination with a different depth of the cavity 108 of the second side 102 compared to the depth of the cavity 107 of the first major side 101

In certain examples, the first major side 101 of the pillow 100 can include two rest areas 116, 118 positioned between the cavity 107 and each lateral sidewall 105, 106 respectively. The rest areas 116, 118 can be used to support the user's head when the user is in a prone position, semi-prone position, or a lateral position. In such positions, the rest areas 116, 118 can interface with a side of the face of the user to support the head of the user. In certain examples, one or more of the rest areas 116, 118 can include channels 120. In some examples, the channels 120 can be in the shape of a chevron (e.g., <, >, ∧, ∨). In some examples, the channels 120, in the form of chevrons, can form an "X" shape. The channels 120 can provide different levels of softness for supporting the side of the face of the user and for supporting a jaw of the user.

In certain examples, the second major side 102 of the pillow 100 can include two rest areas 130, 132 positioned between the cavity 108 and each lateral sidewall 105, 106 respectively. The rest areas 130, 132 can be used to support the user's head on the second side 102 of the pillow 100 when the user is in a prone position, semi-prone position, or a lateral position. In such positions, the rest areas 130, 132 can interface with a side of the face of the user to support the head of the user. In certain examples, one or more of the rest areas 130, 132 can include channels 120. In some examples, the channels 120 can be in the shape of a chevron (e.g., <, >, ∧, ∨). In some examples, the channels 120, in the form of chevrons, can form an "X" shape. The channels 120 can provide different levels of softness for supporting the side of the face of the user and for supporting a jaw of the user.

The lateral sidewalls 105, 106 of the pillow 100 can unite the first and second major sides 101, 102 and can also unite the first and second longitudinal sidewalls 103, 104. In certain examples, the lateral sidewalls 105, 106 can "square-up" the shape of the pillow 100. In some examples, the lateral sidewalls 105, 106 do not "square-up" the pillow 100 but taper the lateral edges of the pillow 100. Tapered edges of a pillow 100 can provide softer support for a user. In some examples, the lateral sidewalls 105, 106 can include channels 122 that run parallel with the length of the respective lateral sidewall 105, 106. In such examples, the channel 122 of the lateral sidewall 105, 106 can provide additional softness to the edge of the pillow 100 compared to "squared-up" lateral sidewalls or tapered-only lateral sidewalls.

Figure 2:
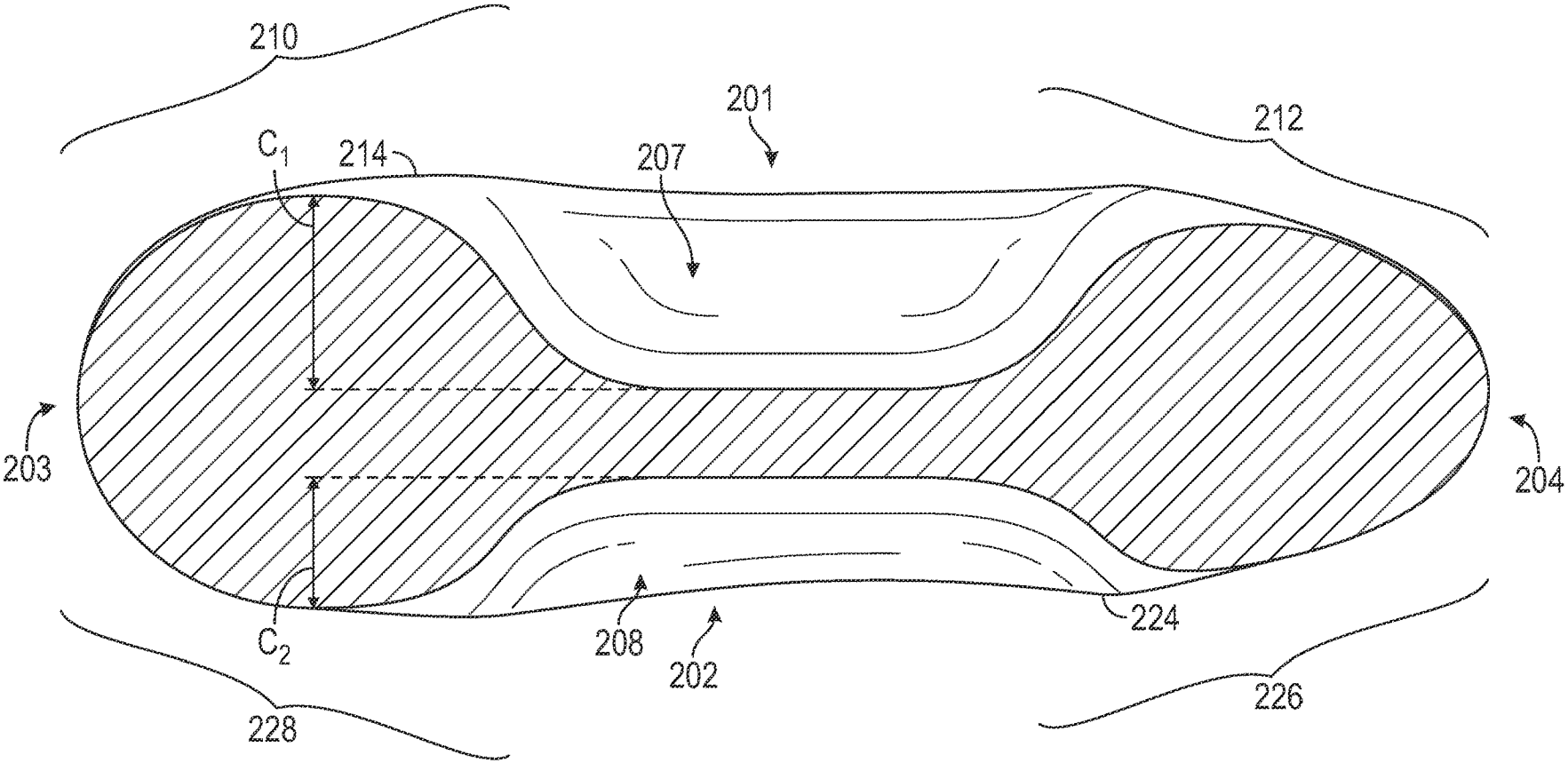
FIG. 2 illustrates generally a cross-section view of an example pillow 200 according to the present subject matter.

As discussed above, each major side of the pillow can include a cavity for supporting the back of the head of the user. In certain examples, the cavity of the first major side can have a different depth than the cavity of the second major side. As such, the pillow can provide at least four distinct combinations of support for the head, neck, and shoulders. FIG. 2 illustrates generally a cross section view of an example pillow 200. The pillow 200 includes a first major side 201, a second major side 201, a first longitudinal sidewall 203 and a second longitudinal sidewall 204. Each major side can include a cavity 207, 208 surrounded by a ring 214, 224 defining a closed shape. A first cavity 207 of the first major side 201 can have a deeper indentation into the pillow 200 than a second cavity 208 of the second major side 202. The major sides 201, 202 can include multiple neck or shoulder support edge areas 210, 212, 226, 228. Two such edge areas 210, 212 associated with the first major side and two such edge areas 226, 228 associated with the second major side.

The cross-section of FIG. 2 illustrates that the example pillow 200 can provide a variety of support options for a user. The variety of support is provided based on the different depths (C1, C2) of the cavities 207, 208 and the different shapes of the first and second longitudinal sidewalls 203, 204. A first level of support can arise form a user lying in a supine position, the user's head supported in the first cavity 207, and the user's neck or shoulders supported on the first edge area 210 of the first side 201. A second level of support can arise form a user lying in a supine position, the user's head supported in the first cavity 207, and the user's neck or shoulders supported on the second edge area 212 of the first side 201. A third level of support can arise form a user lying in a supine position, the user's head supported in the second cavity 208, and the user's neck or shoulders supported on the first edge area 226 of the second side 202. A fourth level of support can arise form a user lying in a supine position, the user's head supported in the second cavity 208, and the user's neck or shoulders supported on the second edge area 228 of the second side 202.

In certain examples, the thickness of the pillow 200 between the first edge area 210 of the first side 201 and the second edge area 228 of the second side 201 can be thicker than the thickness of the pillow 200 between the second edge area 212 of the first side 201 and the first edge area 226 of the second side 201. In certain examples, cross-section shape of the first lateral edge can be different than the cross-section shape of the second lateral edge to provide variability in support with the different orientations a user may use the pillow 200 for head and neck support when in a supine position.

In certain examples, the different shapes of the lateral sidewalls 203, 204, and the aligned location of the cavities 207, 208 can allow, for example, the length of the neck support provided by edge areas 210, 228 near the first lateral sidewall 203, to be longer than the length of the neck support provided by the edge areas 212, 226 near the second lateral sidewall 204, or vice versa.

In certain examples, the pillow (FIGS. 1A and 1B, 100; FIG. 2, 200) can be a unitary piece of molded foam such as polyurethane foam, gel, latex, other resilient, shapeable material, or combinations thereof. In some examples, reference characters (FIGS. 1A, A, B; FIGS. 1B, C, D) can be molded into the material of the pillow to help identify each different support position and the corresponding relative orientation of the pillow and the user. As a user's daily or periodic activities and health can change over time or can be affected by weekly or daily activities, the present subject matter provides a pillow that can provide multiple levels of support to sooth or mitigate aches and discomfort that may come along with the changes. In addition, in certain examples, a single example pillow can accommodate many variations in the physical structure of the human body including, but not limited to, overall size, neck length, head size, trunk size, etc. that can cause variations in sleeping posture, or resting posture.

Additional Examples and Notes

In a first example, Example 1, an apparatus can include a first major side, a second major side, and multiple sidewalls connecting the first major side and the second major side. The multiple sidewalls can include a pair of longitudinal sidewalls and a pair of lateral sidewalls. Each of the first major side and the second major side can include a cavity for receiving a head of a user. Each cavity can include a rim about the entirety of the cavity, and the cavity of the first side can extend deeper into the apparatus than the cavity of the second side.

In Example 2, the first side of Example 1 can optionally include a first neck support forming a first portion of the rim of the cavity of the first side, and a second neck support forming a second portion of the of the cavity pf the first side.

In Example 3, a width of the first neck support of any one or more of Examples 1-2 optionally is wider than a width of the second neck support, wherein the width is measured from the rim immediately adjacent a corresponding neck support of the first and second neck supports of the first side to the longitudinal sidewall adjacent the corresponding neck support.

In Example 4, the second side of any one or more of Examples 1-3 optionally includes a first neck support forming a first portion of the rim of the cavity of the second side, and a second neck support forming a second portion of the of the cavity of the second side.

In Example 5, a width of the first neck support of any one or more of Examples 1-4 optionally is wider than a width of the second neck support, wherein the width is measured from the rim immediately adjacent a corresponding neck support of the first and second neck supports to the longitudinal sidewall adjacent the corresponding neck support.

In Example 6, each of the first side and the second side of any one or more of Examples 1-5 optionally includes a first neck support forming a first portion of the rim of the cavity of a corresponding side, a second neck support forming a second portion of the of the cavity of the corresponding side, and wherein each of the first neck supports have a width that is wider than a width of each of the second neck supports, wherein the width is measured from the rim immediately adjacent a corresponding neck support of the first and second neck supports to the longitudinal sidewall adjacent the corresponding neck support.

In Example 7, the apparatus of any one or more of Examples 1-6 optionally includes a single piece of foam defining the first side, the second side, and the multiple sidewalls.

In Example 8, the lateral sidewalls of any one or more of Examples 1-7 optionally include a concave indentation configured to soften support at the lateral edge of the apparatus.

In Example 9, a first area of a surface of the first side of any one or more of Examples 1-8 optionally includes multiple concave channels, the first area located between the cavity of the first side and a first lateral sidewall.

In Example 10, each of the multiple concave channels of any one or more of Examples 1-9 optionally is a chevron-shaped character.

In Example 11, the multiple concave channels of the first area of any one or more of Examples 1-10 optionally form an "X".

In Example 12, a single unitary piece of polyurethane foam can define the first side, the second side and the multiple sidewalls of any one or more of Examples 1-11.

In Example 13, the apparatus of any one or more of Examples 1-12 is a single, unitary piece of polyurethane foam.

Example 14 is a neck support providing four separate levels of support, comprising: a first major side having a first cavity having a first depth and a first rim about the first cavity; a second major side having a second cavity having a second depth and a second rim about the second cavity; and first and second longitudinal sidewalls connecting the first and second major sides, wherein the first major side includes, a first edge area between the first longitudinal sidewall and the first cavity and a second edge area between the second longitudinal sidewall and the first cavity, wherein the second major side includes a first edge area between the first longitudinal sidewall and the second cavity and a second edge area between the second longitudinal sidewall and the second cavity, wherein the first depth is different than the second depth, wherein a width of the first edge area of the first major side between the first longitudinal sidewall and the first rim proximate the first longitudinal sidewall is different than a width of the second edge area of the first major side between the second longitudinal sidewall and the first rim proximate the second longitudinal sidewall, wherein a width of the first edge area of the second major side between the first longitudinal sidewall and the first rim proximate the first longitudinal sidewall is different than a width of the second edge area of the second major side between the second longitudinal sidewall and the first rim proximate the second longitudinal sidewall, and wherein the different widths of the first and second edge areas of the first and second major sides in combination with the respective first and second depths of the first and second cavities provide four separate levels of support of the neck support.

In Example 15, the subject matter of Example 14 includes, wherein the first and second cavities are each shaped to receive a head of a user, and wherein the width of the first edge area of the first major side is different than the width of the first edge area of the second major side, and the width of the second edge area of the second major side is different than the width of the second edge area of the second major side.

In Example 16, the subject matter of Example 15 includes, wherein the widths of the first and second edge areas of the first major side and the first and second edge areas of the second major side are each different widths.

In Example 17, the subject matter of Examples 14-16 includes, wherein the first longitudinal sidewall has a different shape and thickness than the second longitudinal sidewall to provide different levels of neck or shoulder support of a user, and wherein the shape of the first longitudinal sidewall has a thicker cross-section than the shape of the second longitudinal sidewall.

In Example 18, the subject matter of Examples 14-17 includes, wherein a width of the first cavity is wider proximate the first edge area than the second edge area of the first major side, and wherein a width of the second cavity is wider proximate the first edge area than the second edge of the second major side.

In Example 19, the subject matter of Examples 14-18 includes, wherein the first and second edge areas of the first major side include different portions of an edge or sidewall of the first cavity, and wherein the first and second edge areas of the second major side include different portions of an edge or sidewall of the second cavity.

In Example 20, the subject matter of Examples 14-19 includes, first and second lateral sidewalls; and a single piece of foam defining the first and second major sides, the first and second lateral sidewalls, and the first and second longitudinal sidewalls.

In Example 21, the subject matter of Example 20 includes, wherein the first and second lateral sidewalls include a concave indentation configured to soften support at a lateral edge of neck support.

In Example 22, the subject matter of Examples 20-21 includes, wherein a first area of a surface of the first major side includes multiple concave channels, the first area located between the first cavity and the first lateral sidewall.

Example 23 is an apparatus comprising: a first major side; a second major side; and multiple sidewalls connecting the first major side and the second major side, the multiple sidewalls including a pair of longitudinal sidewalls and a pair of lateral sidewalls, wherein each of the first major side and the second major side include, a cavity for receiving a head of a user, wherein each cavity includes a rim about the entirety of the cavity, and wherein the cavity of the first side extends deeper into the apparatus than the cavity of the second side.

In Example 24, the subject matter of Example 23 includes, wherein the first side includes: a first neck support forming a first portion of the rim of the cavity of the first side; and a second neck support forming a second portion of the of the cavity of the first side.

In Example 25, the subject matter of Example 24 includes, wherein a width of the first neck support is wider than a width of the second neck support, wherein the width is measured from the rim immediately adjacent a corresponding neck support of the first and second neck supports of the first side to the longitudinal sidewall adjacent the corresponding neck support.

In Example 26, the subject matter of Examples 23-25 includes, wherein the second side includes: a first neck support forming a first portion of the rim of the cavity of the second side; and a second neck support forming a second portion of the of the cavity of the second side.

In Example 27, the subject matter of Example 26 includes, wherein a width of the first neck support is wider than a width of the second neck support, wherein the width is measured from the rim immediately adjacent a corresponding neck support of the first and second neck supports to the longitudinal sidewall adjacent the corresponding neck support.

In Example 28, the subject matter of Examples 23-27 includes, wherein each of the first side and the second side include: a first neck support forming a first portion of the rim of the cavity of a corresponding side; and a second neck support forming a second portion of the of the cavity of the corresponding side, wherein each of the first neck supports have a width that is wider than a width of each of the second neck supports, wherein the width is measured from the rim immediately adjacent a corresponding neck support of the first and second neck supports to the longitudinal sidewall adjacent the corresponding neck support.

In Example 29, the subject matter of Examples 23-28 includes, a single piece of foam defining the first side, the second side, and the multiple sidewalls.

In Example 30, the subject matter of Examples 23-29 includes, wherein the lateral sidewalls include a concave indentation configured to soften support at a lateral edge of the apparatus.

In Example 31, the subject matter of Examples 23-30 includes, wherein a first area of a surface of the first side includes multiple concave channels, the first area located between the cavity of the first side and a first lateral sidewall.

In Example 32, the subject matter of Example 31 includes, wherein each of the multiple concave channels is a chevron-shaped character, and wherein the multiple concave channels of the first area form an "X".

Example 33 is a neck support providing four separate levels of support, comprising: a first major side having a first cavity having a first depth and a first rim about the first cavity; a second major side having a second cavity having a second depth and a second rim about the second cavity; and multiple sidewalls connecting the first and second major sides, comprising first and second longitudinal sidewalls and first and second lateral sidewalls, wherein the first and second cavities are each shaped to receive a head of a user, wherein the first major side includes, a first edge area between the first longitudinal sidewall and the first cavity and a second edge area between the second longitudinal sidewall and the first cavity, wherein the second major side includes a first edge area between the first longitudinal sidewall and the second cavity and a second edge area between the second longitudinal sidewall and the second cavity, wherein the first depth is different than the second depth, wherein each of the first and second edge areas of the first and second major sides each have different widths, wherein a width of the first cavity is wider proximate the first edge area than the second edge area of the first major side and a width of the second cavity is wider proximate the first edge area than the second edge of the second major side, wherein the first longitudinal sidewall has a different shape and thickness than the second longitudinal sidewall, wherein the different widths of the first and second edge areas of the first and second major sides in combination with the respective first and second depths of the first and second cavities and the different shapes and thicknesses of the first and second longitudinal sidewalls provide four separate levels of support of the neck support, wherein the first and second lateral sidewalls include a concave indentation configured to soften support at a lateral edge of the neck support, and wherein a first area of a surface of the first major side includes multiple concave channels, the first area located between the first cavity and the first lateral sidewall.

Example 34 is at least one machine-readable medium including instructions that, when executed by processing circuitry, cause the processing circuitry to perform operations to implement of any of Examples 1-33.

Example 35 is an apparatus comprising means to implement of any of Examples 1-33.

Example 36 is a system to implement of any of Examples 1-33.

Example 37 is a method to implement of any of Examples 1-33.

Each of these non-limiting examples can stand on its own, or can be combined with one or more of the other examples in any permutation or combination. The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, the terms "including" and "comprising" are open-ended, that is, a system, device, article, composition, formulation, or process that includes elements in addition to those listed after such a term in a claim are still deemed to fall within the scope of that claim. Moreover, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of any claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. The following aspects are hereby incorporated into the Detailed Description, with each aspect standing on its own as a separate embodiment, and it is contemplated that such embodiments can be combined with each other in various combinations or permutations.

What is claimed is:

1. A neck support providing four separate levels of support, comprising:

a first major side having one single cavity, the one single cavity of the first major side being a first cavity configured for supporting a back of a head of a user, the first cavity having a first depth and a first rim about the first cavity;

a second major side having one single cavity, the one single cavity of the second major side being a second cavity configured for supporting the back of the head of the user, the second cavity having a second depth and a second rim about the second cavity; and first and second longitudinal sidewalls connecting the first and second major sides, wherein the first major side includes a first edge area between the first longitudinal sidewall and the first cavity and a second edge area between the second longitudinal sidewall and the first cavity, wherein the second major side includes a first edge area between the first longitudinal sidewall and the second cavity and a second edge area between the second longitudinal sidewall and the second cavity, wherein the first depth is different than the second depth, wherein a width of the first edge area of the first major side between the first longitudinal sidewall and the first rim proximate the first longitudinal sidewall is different than a width of the second edge area of the first major side between the second longitudinal sidewall and the first rim proximate the second longitudinal sidewall, wherein a width of the first edge area of the second major side between the first longitudinal sidewall and the first rim proximate the first longitudinal sidewall is different than a width of the second edge area of the second major side between the second longitudinal sidewall and the first rim proximate the second longitudinal sidewall, wherein the different widths of the first and second edge areas of the first and second major sides in combination with the respective first and second depths of the first and second cavities provide four separate levels of support of the neck support, wherein the first and second cavities are each sized and shaped to receive and envelop the back of the head of the user when shoulders of the user are aligned with one of the first or second longitudinal sidewalls, wherein the first rim of the first cavity forms a closed shape around the first cavity and the head of the user when the back of the head of the user is in the first cavity, wherein the second rim of the second cavity forms a closed shape around the second cavity and the head of the user when the back of the head of the user is in the second cavity, and wherein the width of the first edge area of the first major side is different than the width of the first edge area of the second major side, and the width of the second edge area of the second major side is different than the width of the second edge area of the second major side.

2. The neck support of claim 1, wherein the widths of the first and second edge areas of the first major side and the first and second edge areas of the second major side are each different widths.

3. The neck support of claim 1, wherein the first longitudinal sidewall has a different shape and thickness than the second longitudinal sidewall to provide different levels of neck or shoulder support of a user, and wherein the shape of the first longitudinal sidewall has a thicker cross-section than the shape of the second longitudinal sidewall.

4. The neck support of claim 1, wherein a width of the first cavity is wider proximate the first edge area than the second edge area of the first major side, and wherein a width of the second cavity is wider proximate the first edge area than the second edge of the second major side.

5. The neck support of claim 1, wherein the first and second edge areas of the first major side include different portions of an edge or sidewall of the first cavity, and wherein the first and second edge areas of the second major side include different portions of an edge or sidewall of the second cavity.

6. The neck support of claim 1, comprising:

first and second lateral sidewalls; and a single piece of foam defining the first and second major sides, the first and second lateral sidewalls, and the first and second longitudinal sidewalls.

7. The neck support of claim 6, wherein the first and second lateral sidewalls include a concave indentation configured to soften support at a lateral edge of neck support.

8. The neck support of claim 6, wherein a first area of a surface of the first major side includes multiple concave channels for supporting a side of a face of the user, the first area located between the first cavity and the first lateral sidewall, the multiple concave channels separate from the first and second cavities.

9. An apparatus comprising:

a first major side;

a second major side; and multiple sidewalls connecting the first major side and the second major side, the multiple sidewalls including a pair of longitudinal sidewalls and a pair of lateral sidewalls, wherein the first major side has one single cavity configured for receiving a back of a head of a user and the second major side has one single cavity configured for receiving the back of the head of the user, wherein each single cavity includes a continuous rim at a continuous level about the entirety of the cavity, wherein the one single cavity of the first side extends deeper into the apparatus than the one single cavity of the second side, wherein the one single cavity of the first major and the one single cavity of the second major side are each sized and shaped to receive and envelop the back of the head of the user when shoulders of the user are aligned with one of the first or second longitudinal sidewalls, wherein a first rim of the one single cavity of the first major side forms a closed shape around the one single cavity of the first major side and the head of the user when the back of the head of the user is in the one single cavity of the first major side, wherein a second rim of the one single cavity of the second major side forms a closed shape around the one single cavity of the second major side and the head of the user when the back of the head of the user is in the one single cavity of the second major side.

10. The apparatus of claim 9, wherein the first side includes: a first neck support forming a first portion of the rim of the cavity of the first side; and a second neck support forming a second portion of the cavity of the first side.

11. The apparatus of claim 10, wherein a width of the first neck support is wider than a width of the second neck support, wherein the width is measured from the rim immediately adjacent a corresponding neck support of the first and second neck supports of the first side to the longitudinal sidewall adjacent the corresponding neck support.

12. The apparatus of claim 9, wherein the second side includes: a first neck support forming a first portion of the rim of the cavity of the second side; and a second neck support forming a second portion of the cavity of the second side.

13. The apparatus of claim 12, wherein a width of the first neck support is wider than a width of the second neck support, wherein the width is measured from the rim immediately adjacent a corresponding neck support of the first and second neck supports to the longitudinal sidewall adjacent the corresponding neck support.

14. The apparatus of claim 9, wherein each of the first side and the second side include:

a first neck support forming a first portion of the rim of the cavity of a corresponding side; and a second neck support forming a second portion of the cavity of the corresponding side, wherein each of the first neck supports have a width that is wider than a width of each of the second neck supports, wherein the width is measured from the rim immediately adjacent a corresponding neck support of the first and second neck supports to the longitudinal sidewall adjacent the corresponding neck support.

15. The apparatus of claim 9, including a single piece of foam defining the first side, the second side, and the multiple sidewalls.

16. The apparatus of claim 9, wherein the lateral sidewalls include a concave indentation configured to soften support at a lateral edge of the apparatus.

17. The apparatus of claim 9, wherein a first area of a surface of the first side includes multiple concave channels, the first area located between the cavity of the first side and a first lateral sidewall.

18. The apparatus of claim 17, wherein each of the multiple concave channels is a chevron-shaped character, and wherein the multiple concave channels of the first area form an "X".

19. A neck support providing four separate levels of support, comprising:

a first major side having one single cavity, the one single cavity of the first major side being a first cavity configured for supporting a back of a head of a user, the first cavity having a first depth and a first rim about the first cavity;

a second major side having one single cavity, the one single cavity of the second major side being a second cavity configured for supporting the back of the head of the user, the second cavity having a second depth and a second rim about the second cavity; and multiple sidewalls connecting the first and second major sides, comprising first and second longitudinal sidewalls and first and second lateral sidewalls, wherein the first and second cavities are each shaped and configured to receive a head of a user, wherein the first major side includes a first edge area between the first longitudinal sidewall and the first cavity and a second edge area between the second longitudinal sidewall and the first cavity, wherein the second major side includes a first edge area between the first longitudinal sidewall and the second cavity and a second edge area between the second longitudinal sidewall and the second cavity, wherein the first depth is different than the second depth, wherein each of the first and second edge areas of the first and second major sides each have different widths, wherein a width of the first cavity is wider proximate the first edge area than the second edge area of the first major side and a width of the second cavity is wider proximate the first edge area than the second edge of the second major side, wherein the first longitudinal sidewall has a different shape and thickness than the second longitudinal sidewall, wherein the different widths of the first and second edge areas of the first and second major sides in combination with the respective first and second depths of the first and second cavities and the different shapes and thicknesses of the first and second longitudinal sidewalls provide four separate levels of support of the neck support, wherein the first and second lateral sidewalls include a concave indentation configured to soften support at a lateral edge of the neck support, wherein a first area of a surface of the first major side includes multiple concave channels configured for supporting a side of a face of the user, the first area located between the first cavity and the first lateral sidewall, the multiple concave channels separate from the first and second cavities, and wherein the first and second rims are each continuous rims at respective continuous levels about the entirety of the respective first and second cavities, each forming a closed shape around the respective first and second cavities.

* * * * *